US011248428B2

(12) United States Patent
Schultz, Jr. et al.

(10) Patent No.: US 11,248,428 B2
(45) Date of Patent: Feb. 15, 2022

(54) WELLBORE APPARATUS FOR SETTING A DOWNHOLE TOOL

(71) Applicant: Weatherford Technology Holdings, LLC, Houston, TX (US)

(72) Inventors: William Allen Schultz, Jr., Cypress, TX (US); David W. Teale, Spring, TX (US); Richard C. Davis, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 283 days.

(21) Appl. No.: 16/270,426

(22) Filed: Feb. 7, 2019

(65) Prior Publication Data

US 2020/0256142 A1 Aug. 13, 2020

(51) Int. Cl.

| | |
|---|---|
| ***E21B 23/01*** | (2006.01) |
| ***E21B 33/128*** | (2006.01) |
| ***E21B 33/129*** | (2006.01) |
| *E21B 29/00* | (2006.01) |

(52) U.S. Cl.
CPC ..... *E21B 23/01* (2013.01); *E21B 33/128* (2013.01); *E21B 33/1293* (2013.01); *E21B 29/005* (2013.01)

(58) Field of Classification Search
CPC .... E21B 23/00; E21B 33/128; E21B 33/1293; E21B 29/005
See application file for complete search history.

(56) References Cited

U.S. PATENT DOCUMENTS

| | | | |
|---|---|---|---|
| 3,963,081 | A | 6/1976 | Anderson et al. |
| 4,044,826 | A | 8/1977 | Crowe |
| 4,180,132 | A | 12/1979 | Young |
| 4,487,258 | A | 12/1984 | Jackson et al. |
| 4,550,781 | A | 11/1985 | Kagler, Jr. |
| 4,669,538 | A | 6/1987 | Szarka |
| 5,101,895 | A | 4/1992 | Gilbert |
| 5,103,903 | A | 4/1992 | Marks, II |
| 6,056,049 | A | 5/2000 | Davis |
| 6,357,528 | B1 | 3/2002 | Davis et al. |
| 6,629,565 | B2 | 10/2003 | Harrell |
| 7,426,964 | B2 | 9/2008 | Lynde et al. |
| 7,757,754 | B2 | 7/2010 | McKay |
| 8,403,038 | B2 | 3/2013 | Russell et al. |
| 8,403,061 | B2 | 3/2013 | Russell et al. |

(Continued)

FOREIGN PATENT DOCUMENTS

| | | | |
|---|---|---|---|
| EP | 0216527 | A2 | 4/1987 |
| EP | 0504848 | A1 | 9/1992 |

(Continued)

OTHER PUBLICATIONS

United Kingdom Combined Search and Examination Report dated Apr. 7, 2020, for Application No. GB2001021.1.

*Primary Examiner* — Yong-Suk (Philip) Ro
(74) *Attorney, Agent, or Firm* — Patterson + Sheridan, LLP

(57) ABSTRACT

A method and apparatus for a locking system for a downhole tool. The locking system includes a first portion having a plurality of displaceable members, a second portion disposed around the first portion; a locked position wherein axial movement between the members is prevented; and an unlocked position wherein axial movement between the members is permitted.

16 Claims, 21 Drawing Sheets

(56) References Cited

U.S. PATENT DOCUMENTS

| | | | | |
|---|---|---|---|---|
| 8,527,100 | B2 | 9/2013 | Russell et al. | |
| 8,869,896 | B2 | 10/2014 | Crow et al. | |
| 8,881,818 | B2 | 11/2014 | Crow et al. | |
| 8,881,819 | B2 | 11/2014 | Crow et al. | |
| 8,893,791 | B2 | 11/2014 | Crow et al. | |
| 8,985,230 | B2 | 3/2015 | Crow et al. | |
| 9,022,117 | B2 | 5/2015 | Segura et al. | |
| 9,416,635 | B2 | 8/2016 | Hekelaar | |
| 9,428,980 | B2 | 8/2016 | Evans | |
| 9,464,496 | B2 | 10/2016 | O'Rourke et al. | |
| 9,790,764 | B2 * | 10/2017 | Ezell | E21B 33/1295 |
| 9,920,584 | B2 | 3/2018 | Pelto et al. | |
| 10,024,127 | B2 | 7/2018 | Plante et al. | |
| 10,041,322 | B2 | 8/2018 | Braddick | |
| 2009/0229832 | A1 * | 9/2009 | King | E21B 33/1295 166/373 |
| 2010/0012330 | A1 * | 1/2010 | Ezell | E21B 33/1285 166/387 |
| 2016/0130901 | A1 | 5/2016 | Coronado et al. | |
| 2018/0216432 | A1 | 8/2018 | Nelson et al. | |

FOREIGN PATENT DOCUMENTS

| | | | |
|---|---|---|---|
| EP | 2662526 | A2 | 11/2013 |
| GB | 2210083 | A | 6/1989 |
| WO | 2011031164 | A1 | 3/2011 |
| WO | 2013133718 | A1 | 9/2013 |
| WO | 2017046613 | A1 | 3/2017 |
| WO | 2017182549 | A1 | 10/2017 |
| WO | 2018046907 | A1 | 3/2018 |
| WO | 2018069685 | A2 | 4/2018 |
| WO | 2018083473 | A1 | 5/2018 |
| WO | 2018142122 | A1 | 8/2018 |
| WO | 2018142123 | A1 | 8/2018 |
| WO | 2018203063 | A1 | 11/2018 |
| WO | 2018211284 | A1 | 11/2018 |

* cited by examiner

WELLBORE APPARATUS FOR SETTING A DOWNHOLE TOOL

BACKGROUND

Field

Embodiments described herein generally relate to a wellbore apparatus for setting a downhole tool. More particularly, the embodiments relate to an apparatus and methods for setting a packer downhole.

Description of the Related Art

Downhole operations are often accomplished with multiple tools on a single work string. Depending on the operation required, the tools are operated in a predetermined sequence. In some instances, it is necessary to ensure one tool does not operate prematurely. There is a need for a downhole mechanism to prevent inadvertent or premature operation of a tool. More specifically, there is a need to prevent inadvertent or premature setting of a downhole packer.

SUMMARY

The present disclosure generally relates to a locking system for a downhole tool comprising a first portion having a plurality of displaceable members, a second portion disposed around the first portion; a locked position wherein axial movement between the members is prevented; and an unlocked position wherein axial movement between the members is permitted. In one embodiment, the invention includes a downhole tool comprising a set of slips for maintaining the tool in an axial location in a wellbore. The slips are flow-actuated initially and then maintained in a set position due to a first upward force applied to the tool in the wellbore. A packer for sealing an annular area around the tool includes a locking system actuated by an additional upward force applied to the tool in the wellbore. In one embodiment, the tool is used in connection with a cutting tool to sever and remove a section of a tubular string lining the wellbore.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

Embodiments of the present disclosure including a tool having a slip assembly and a packer assembly having a locking system to prevent inadvertent or premature setting of the packer.

Figure 1:
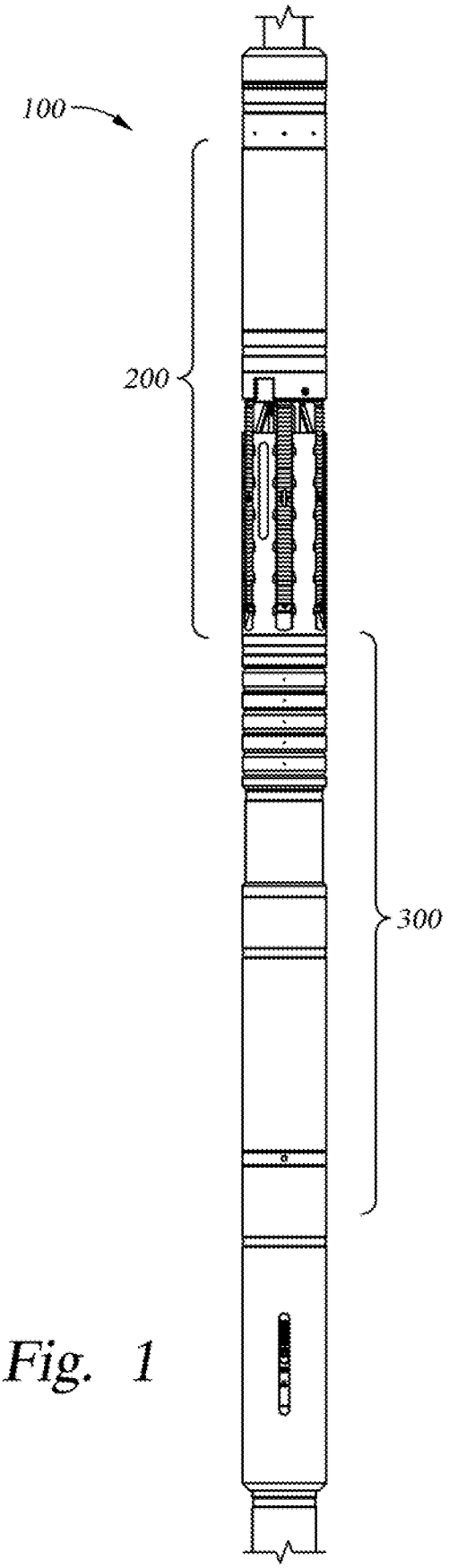
FIG. 1 is a front view of a tool according to one embodiment of the invention.
Figure 2:
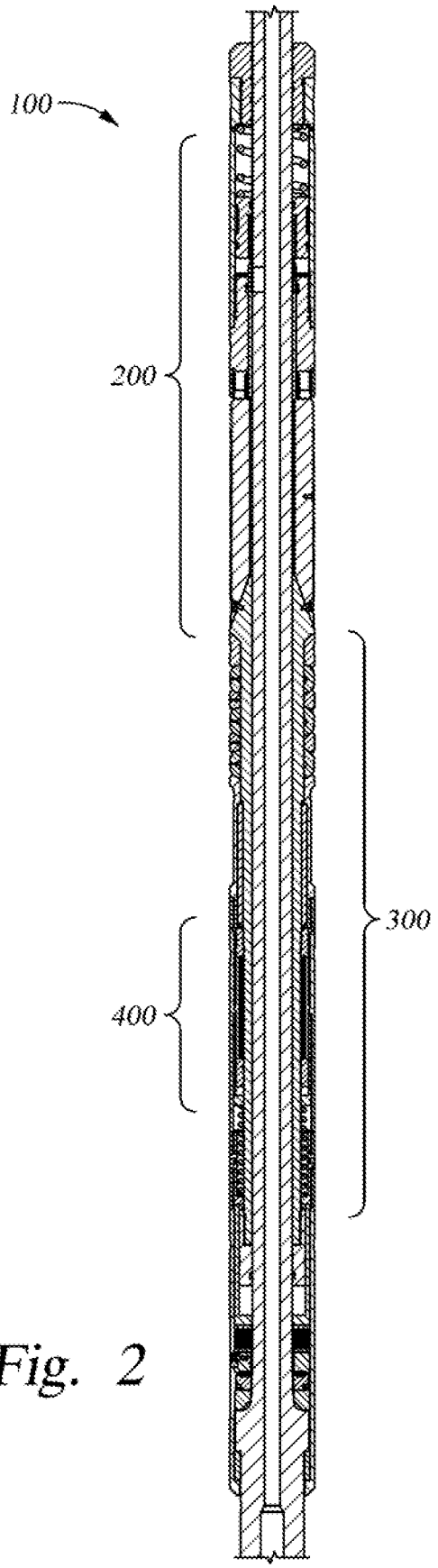
FIG. 2 is a section view of the tool of FIG. 1.

FIG. 1 is a front view of a tool 100 according to one embodiment of the invention. The tool described herein is one that includes a slip assembly 200 and a packer assembly 300, with the packer having a locking system 400 that prevents operation of and setting of the packer until certain conditions are met. Embodiments also include a cutting tool (not shown) disposed below the tool on the same work string. It will be understood however that any number of different tools could be utilized with the tool described herein and the locking system described in relation to the packer assembly 300 is of use on any number of different tools where inadvertent actuation is a potential problem. FIG. 2 is a section view of the tool 100 of FIG. 1.

Figure 3A:
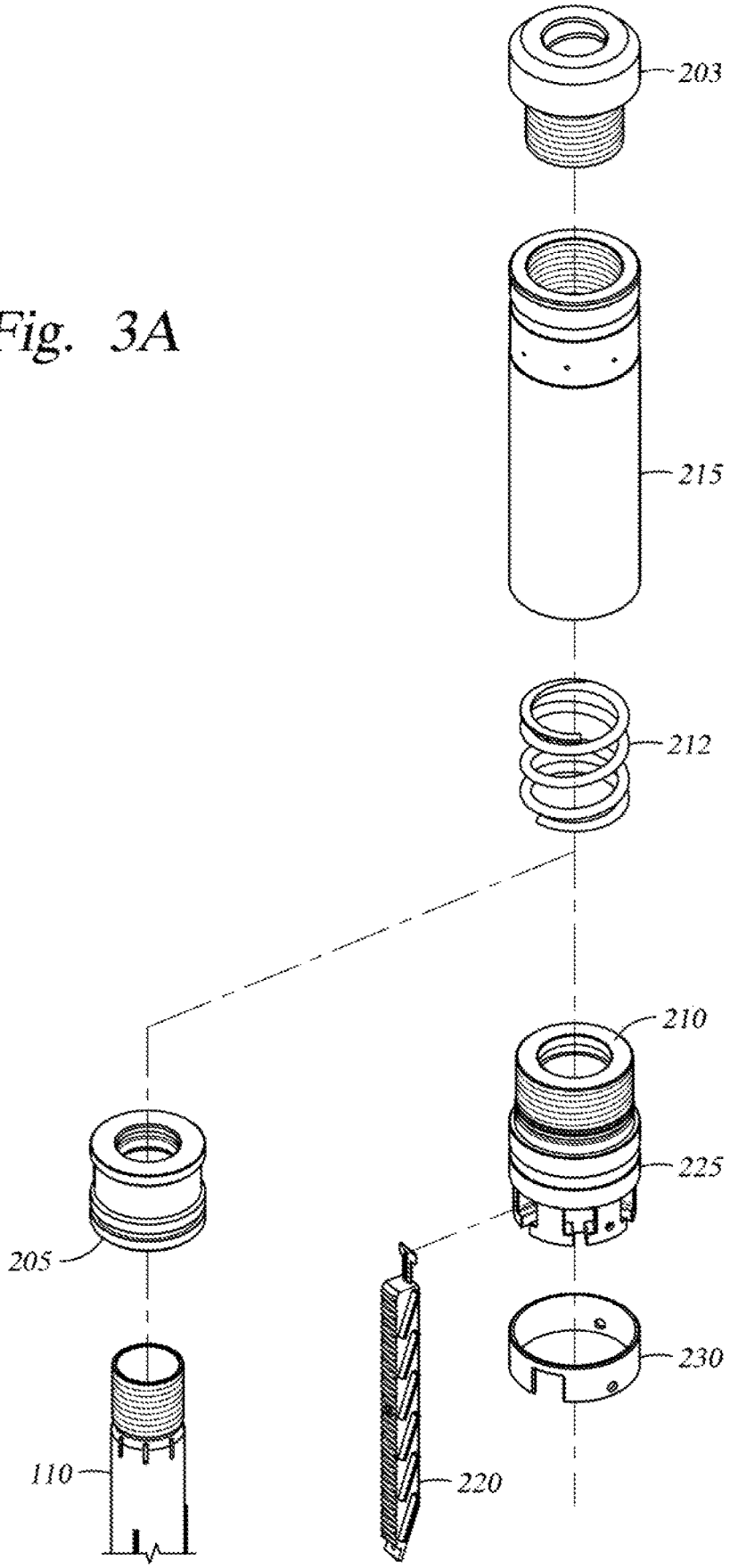
FIG. 3A is an exploded view showing different parts of the tool.
Figure 4A:
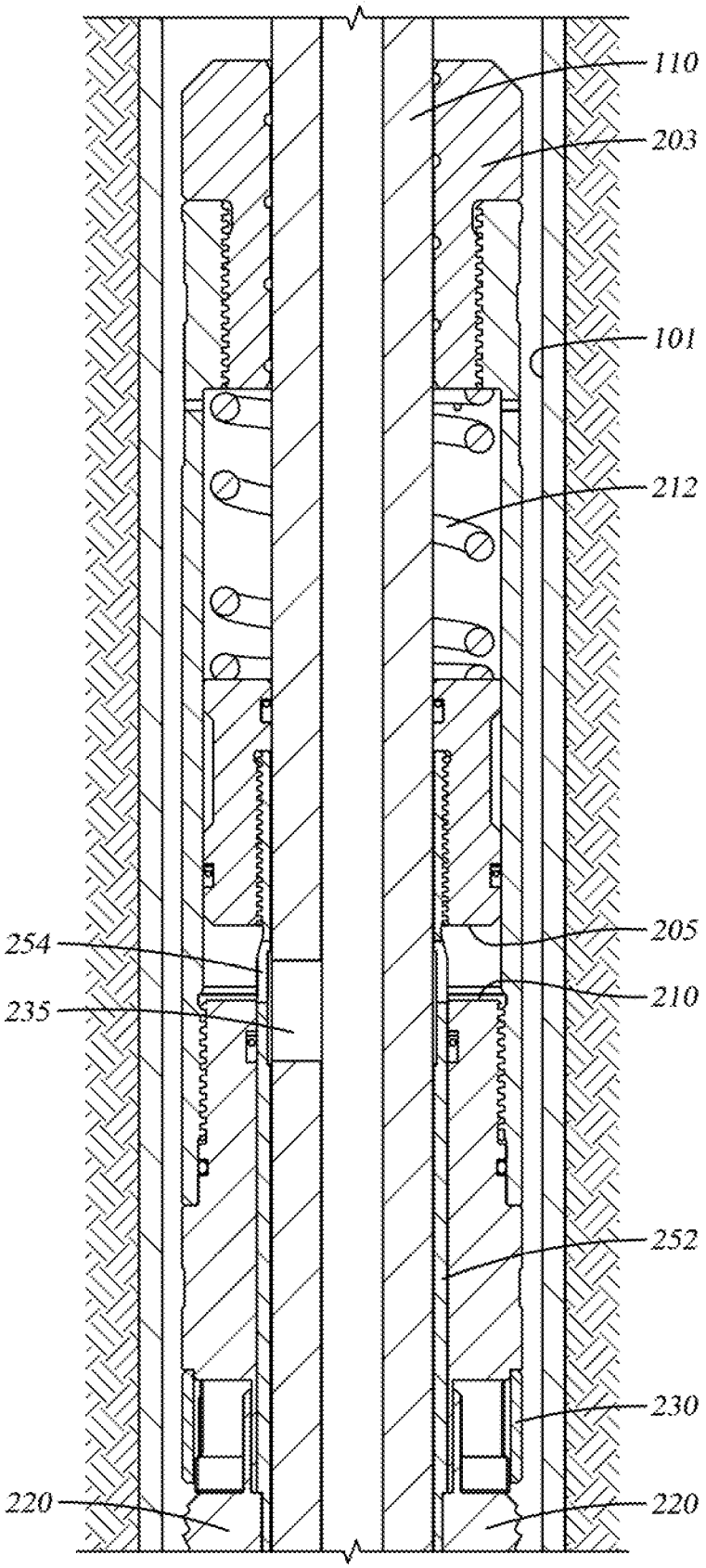
FIGS. 4A-D are section views showing the tool in a run-in position in a wellbore, the tool having a slip assembly and a packer assembly.

FIG. 3A is an exploded view showing different parts of the tool 100. The portions illustrated generally refer to the slip assembly 200 visible in an assembled manner in FIGS. 4A, B. Included are a cap 203, an upper 205 and lower 210 piston surfaces as well as a spring 212 and spring housing 215 to bias the plurality of slips in a run-in and unset position. A slip housing 225 is shown as well as an exemplary slip 220 and slip retainer 230. The various parts of the slip assembly 200 are installed on a mandrel 110.

Figure 3B:
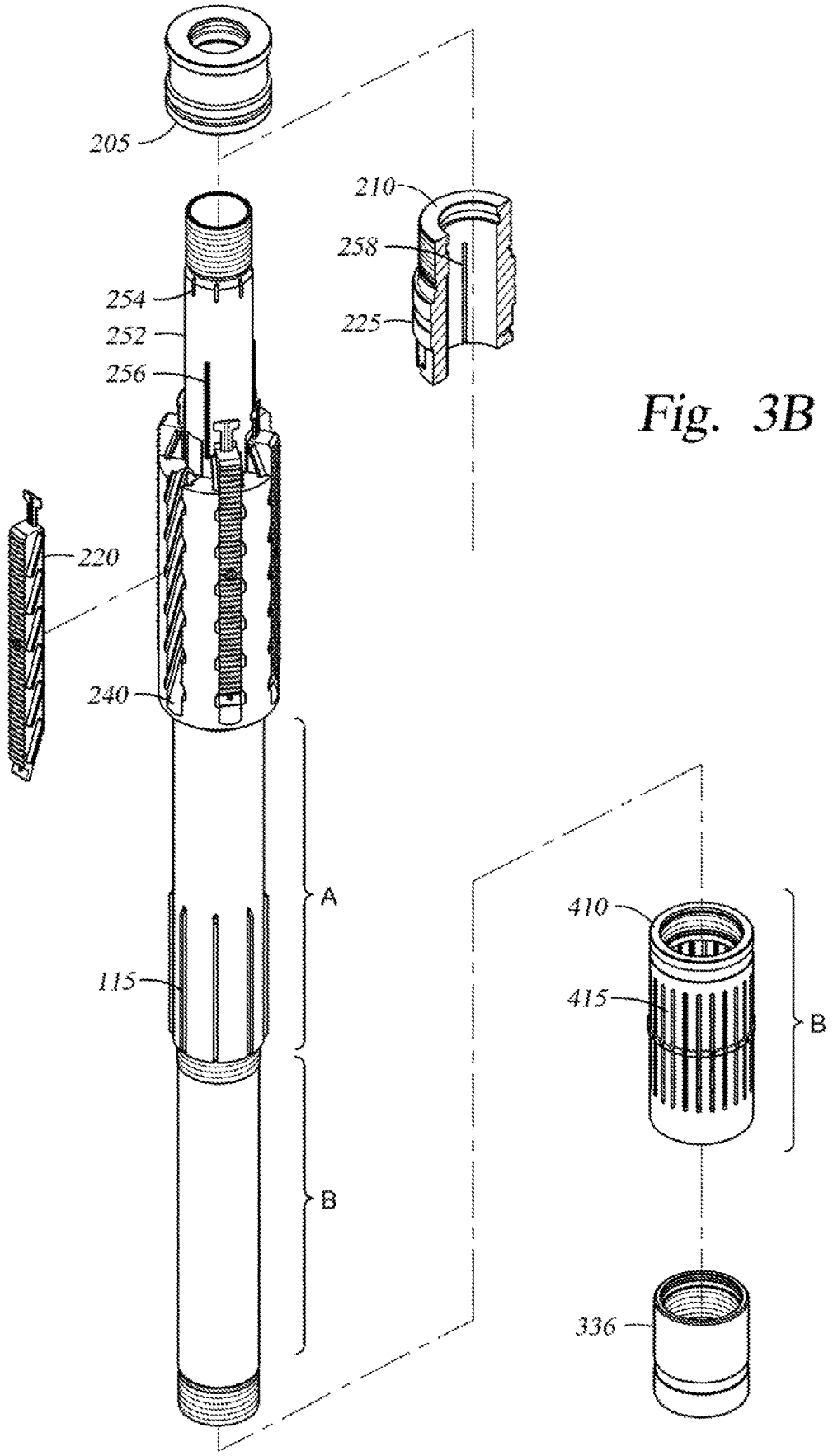
FIG. 3B is an exploded view showing different parts of the tool.

FIG. 3B is an exploded view showing the parts of the slip assembly 200 as well as a portion of the locking system 400 for the packer assembly 300. Areas of FIG. 3B labeled A and B correspond to similarly labeled areas of FIG. 3C. Visible is a housing for sub-assemblies 252 with anti-rotation keys 256 and ribs 115 disposed there upon. The keys interact with key slots 258 formed in piston body adjacent piston surface 210 and ribs 115 interact with slots 130 (FIG. 3D) to permit axial but not rotational movement. Fluid passageways 254 serve to provide a fluid path for fluid used to set the slip assembly 200. Also visible are portions of the slip assembly 200 with the slips 220 installed as well as the upper and lower piston bodies with piston surfaces 205, 210 formed thereon for flow-actuating the slips. Also shown are portions of the locking system 400 for the packer assembly 300 consisting of a collet sleeve 410 having displaceable collet fingers 415 and stop sleeve 336, the functions of which will be described herein.

Figure 3C:
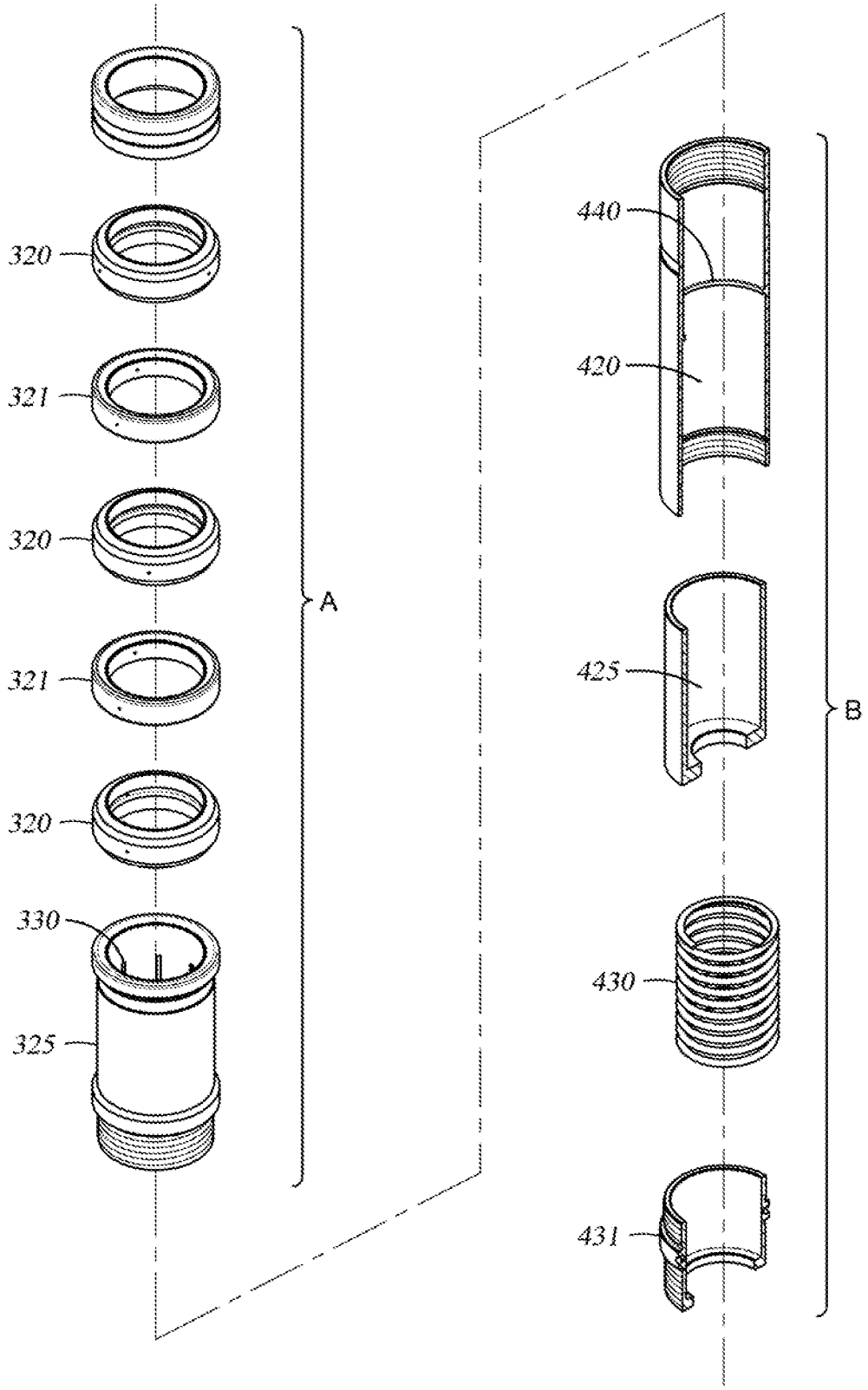
FIG. 3C is an exploded view showing different parts of the tool.

FIG. 3C is an exploded view showing different parts of the tool. On the left hand side of the tool are packer elements 320 separated by spacers 321 that correspond to area A of FIG. 3B and will be disposed on the mandrel 110 below the slip assembly 200 of FIG. 3B. A slot housing 325 includes slots 330 that correspond to the anti-rotation ribs 115 of FIG. 3B. On the right side of the Figure are additional portions of the locking system 400 for the packer including a collet housing 420 for housing the collet sleeve 410 of FIG. 3B as well as a spring loaded sleeve 425 and a spring 430 and spring housing 431 for urging the sleeve upwards into contact with the collet sleeve 410.

Figure 3D:
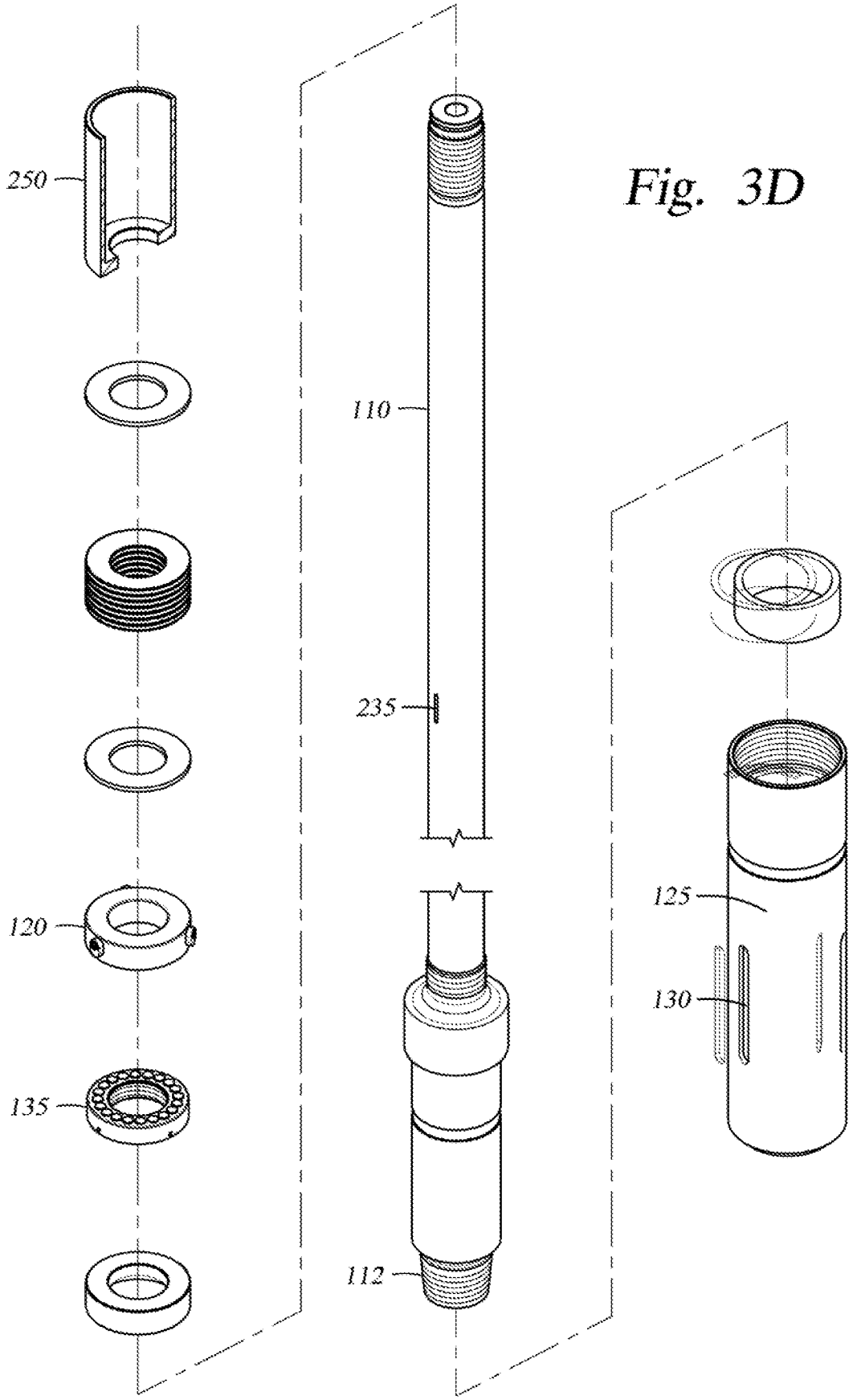
FIG. 3D is an exploded view showing different parts of the tool.

FIG. 3D is an exploded view showing different parts of the tool. In the center of the Figure is the mandrel 110 constructed and arranged to be rotatable in order to rotate another tool (not shown) disposed on the lower end of mandrel via threads 112. The mandrel includes radially disposed fluid slots 235 for the passage of fluid in order to set the slip assembly 200. On each side of the Figure are components, most of which are prevented from rotation by a keyed arrangement between a ring with lugs 120 that operates in conjunction with a sleeve 125 having mating vertical slots 130 permitting axial but not rotational movement between the components. A bearing member 135 facilitates the rotation of the mandrel 110 and other center portions of the assembly in relation to the outer portions.

Figure 4B:
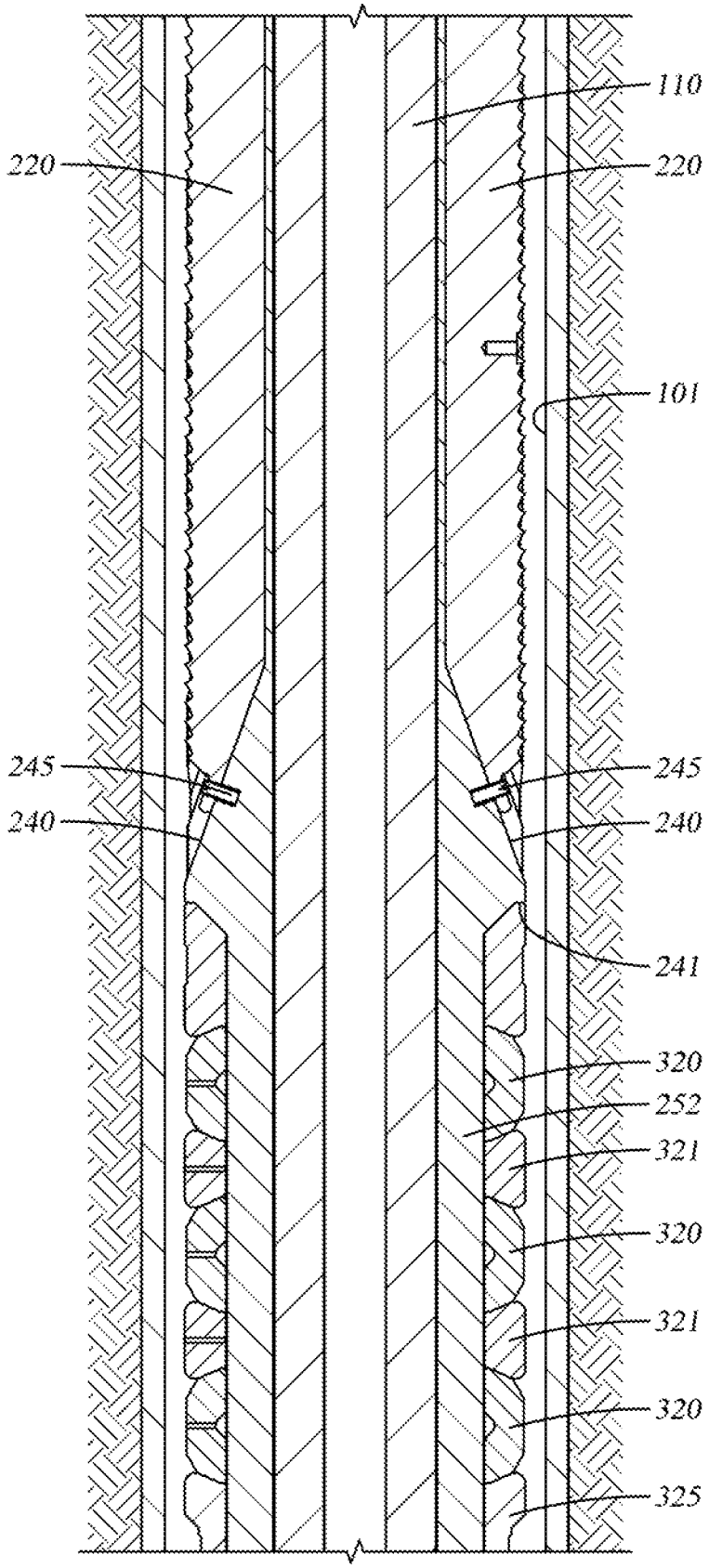

FIGS. 4A-D are section views showing the tool 100 in a run-in position in a wellbore, the tool including the slip assembly 200 and packer assembly 300 with its locking system 400. In this document the term "wellbore wall" refers to an inside wall of a tubular that lines the earthen borehole. Portions of the slip assembly already introduced are visible in FIG. 4A including the cap 203, upper and lower piston surfaces 205, 210 and a port 235 providing a fluid path between an interior of the mandrel 110 and the two piston surfaces. The fluid path includes ports 235 formed in the mandrel 110 as well as fluid passageways 254 formed in the sub-assembly housing 252. FIG. 4B illustrates additional portions of the slip assembly 200 including the slips 220 and a conical shape 240 that serves to urge the slips outwards and into contact with the wellbore wall as they are set. Generally, the slip assembly includes a number of slips 220 constructed and arranged to be urged along the conically shaped member 240 and into a wedging relationship with the walls of the surrounding wellbore 101.

In the embodiment shown, the slips 220 are biased in an unset position by spring 212, the force of which must be overcome to move the cap/slip combination downwards in relation to the conical shape 240. The slips are further held in the run-in position by set screws 245 temporarily connecting the slip members to the conical shape 240. The slip assembly 200 is flow-actuated by pumping fluid through the work string (not shown) upon which the tool 100 is mounted and run into the well. Port 235 (there are typically several radially spaced around the mandrel) located in a wall of the mandrel 110 permits fluid communication between the work string and the two piston surfaces 205, 210, one associated with the slip members and one associated with that part of the assembly on which the conical shape 240 is formed. Fluid pressure separates the two pistons and in doing so, overcomes the bias of the spring 212, causing the set screws 245 to fail and moves the slips 220 to a set position as shown in FIGS. 5A-D. The slips are thereafter retained in the set position due to an upward force applied to the mandrel 110 from the surface which creates a wedge-like condition between the conical shape 240, slips 220, and the wellbore wall 101.

Figure 4C:
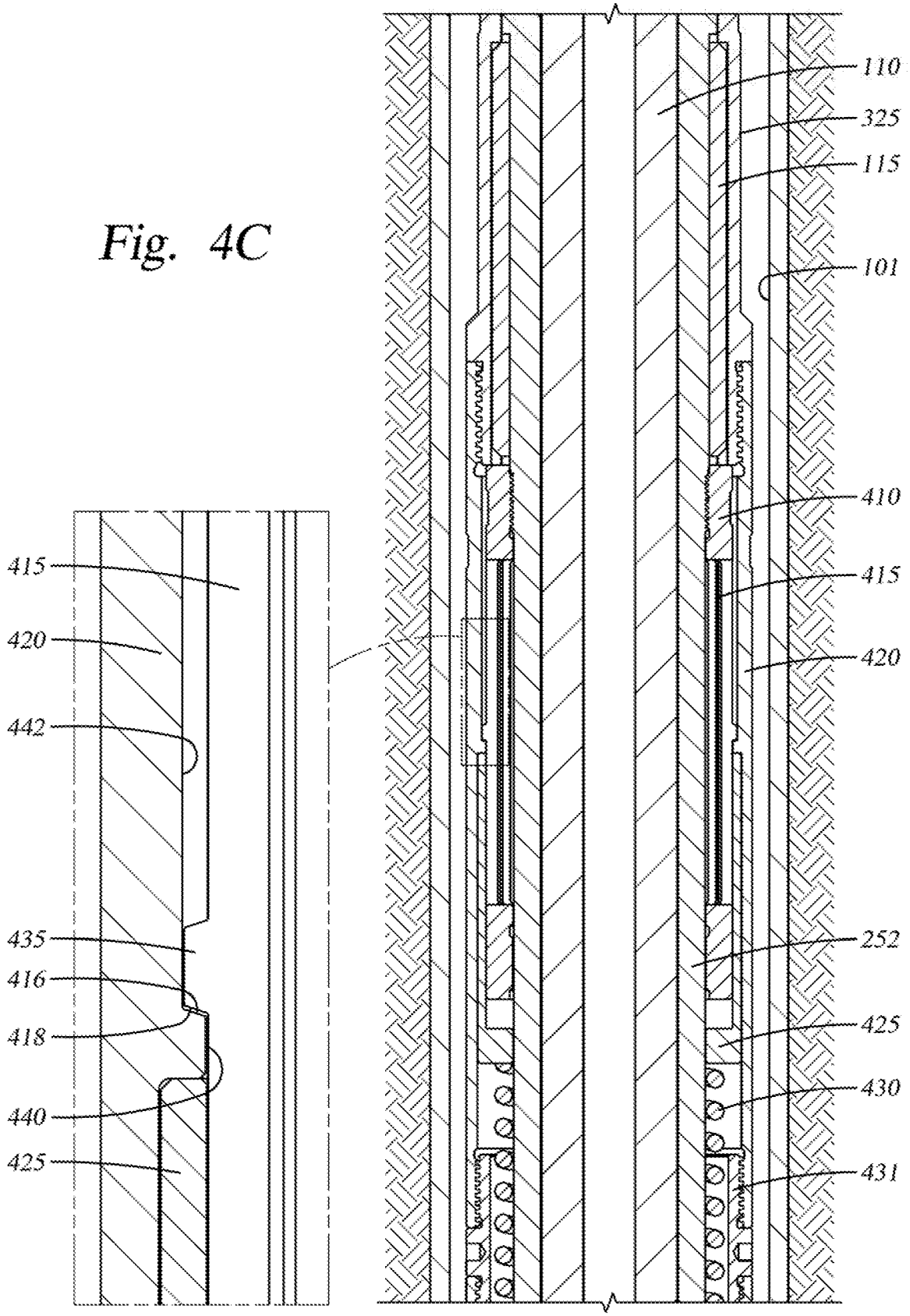
Figure 4D:
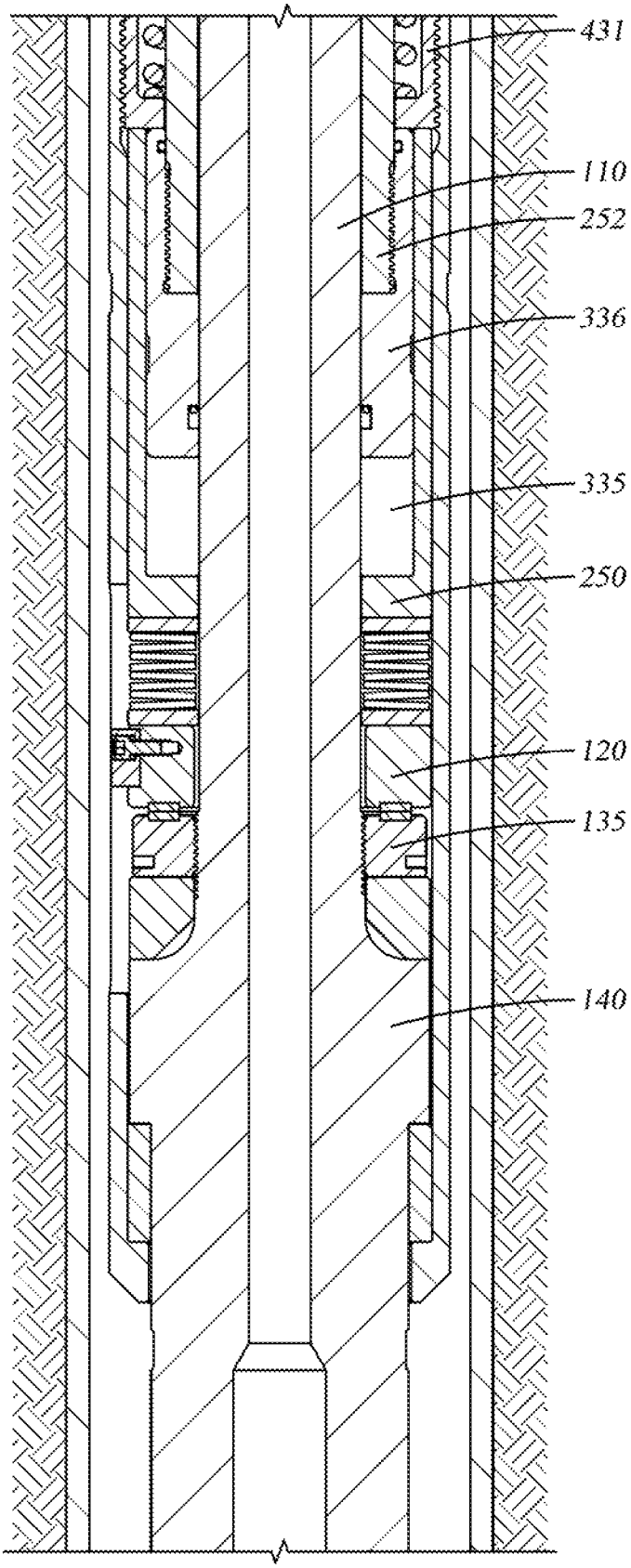
Figure 5A:
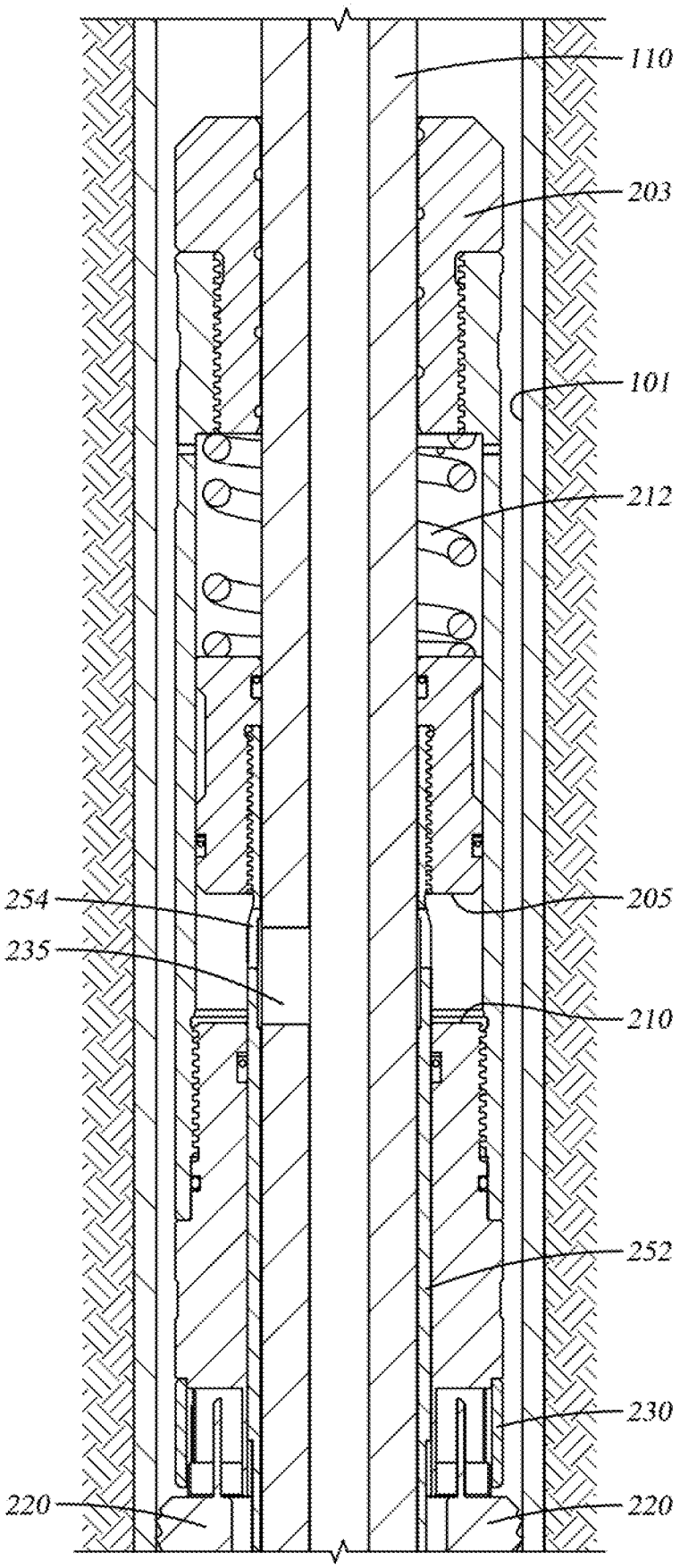
FIGS. 5A-D are section views showing the tool with slips of the slip assembly set in the wellbore and a locking system of the packer assembly in a locked position.
Figure 5B:
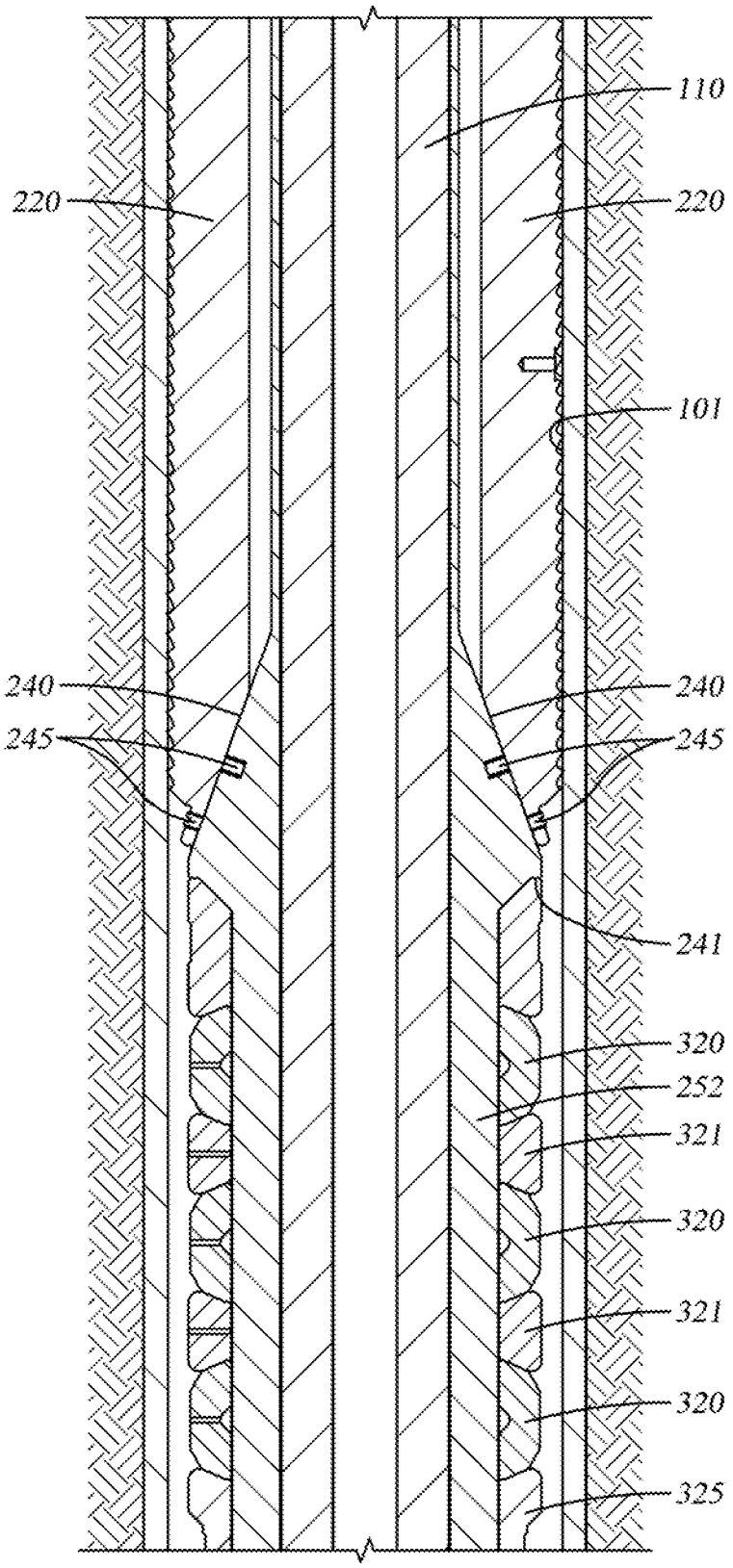
Figure 5C:
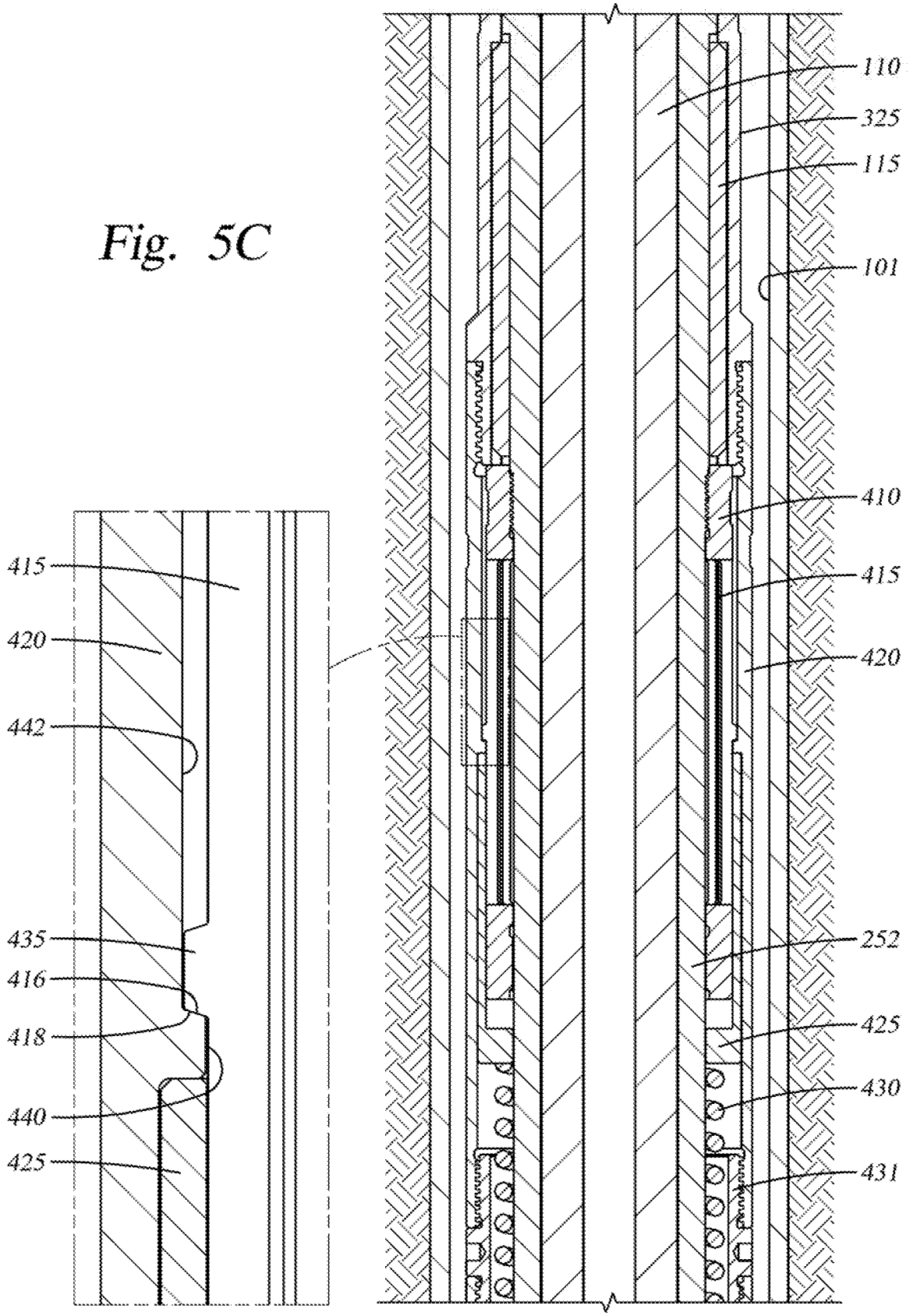
Figure 5D:
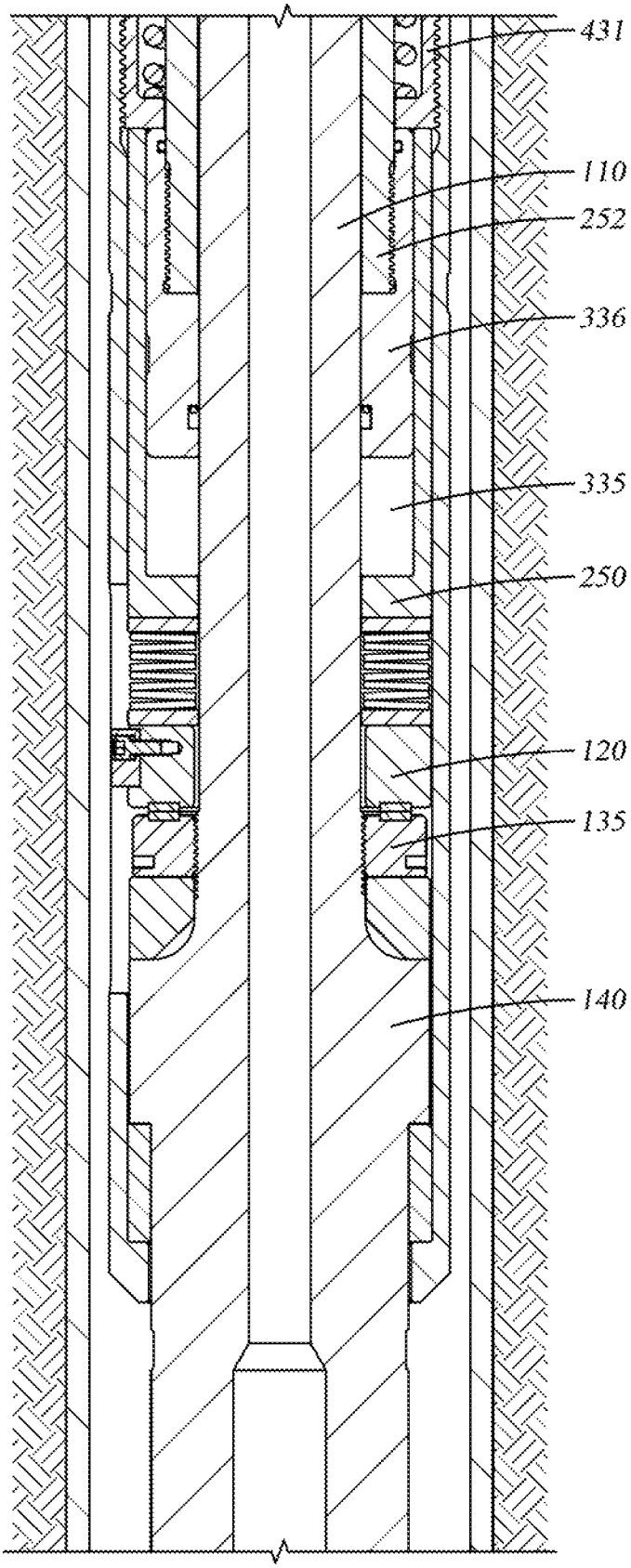

Shown primarily in FIGS. 4B-D is the packer assembly 300 with its locking system 400. The packer is unset. Shown in FIG. 4B are the packing elements 320 and spacers 321 of FIG. 3C, each of which is compressible. The elements are retained at an upper end by a downwardly facing shoulder of the conical shape 240 and at a lower end by an upward facing shoulder movable relative to the underside in order to compress the packer elements. As the slips are set in the wellbore, the packer assembly 300 remains in its original, unset position.

FIGS. 5A-D are section views showing the tool with slips of the slip assembly set in the wellbore and the locking system 400 of the packer retaining the packer in its unset position. Fluid pressure delivered through port 235 has moved lower piston 210 to a lower position relative to the port and with it, the cap 203 which has compressed the biasing spring 212 that was biasing the slip assembly 200 in the run-in position. As can be appreciated from FIG. 5B, the set screws 245 have failed and the slips 220 have moved down and out along the conical shape 240 and into contact with the walls of the wellbore 101. Although the slips 220 have been set, the packer assembly 300 remains in the unset position.

Figure 6A:
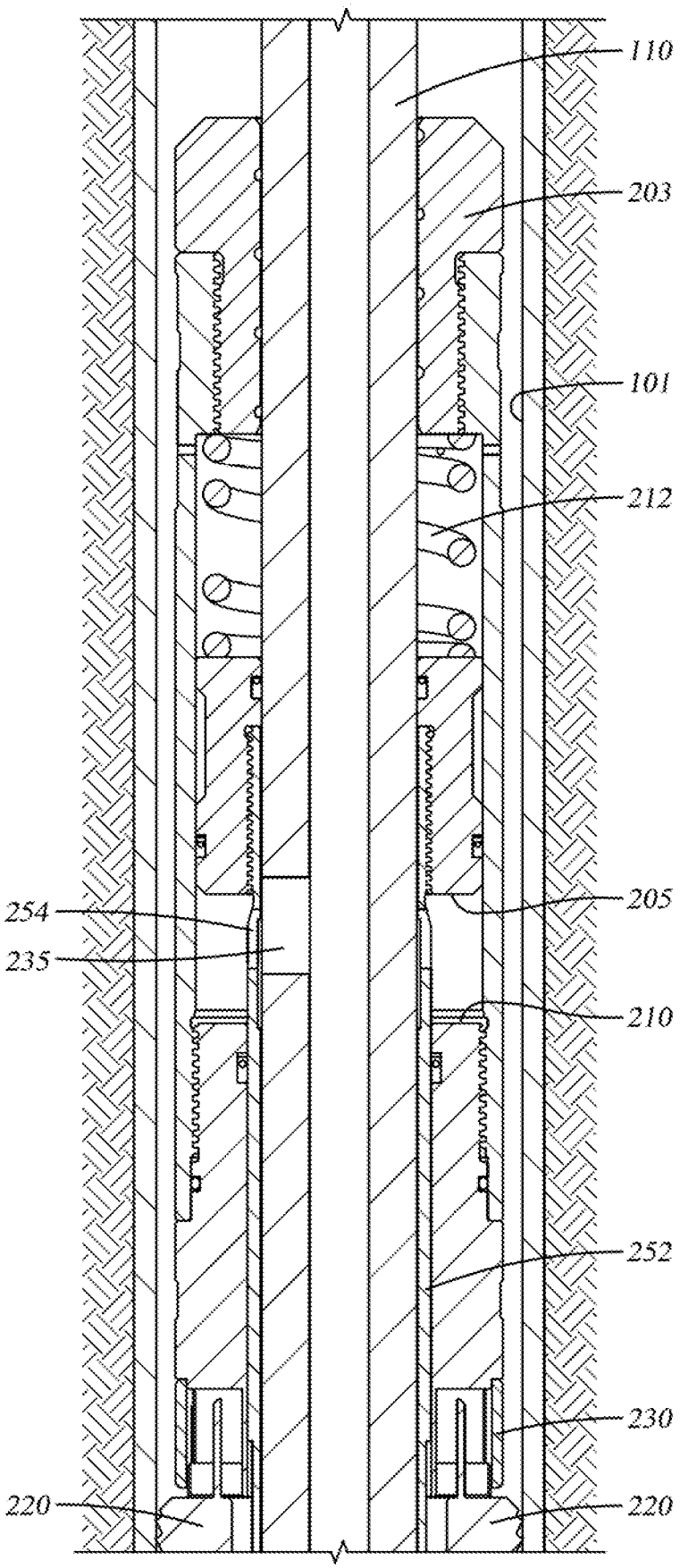
FIGS. 6A-D are section views showing the tool in the wellbore with the locking system of the packer in an unlocked position.
Figure 6B:
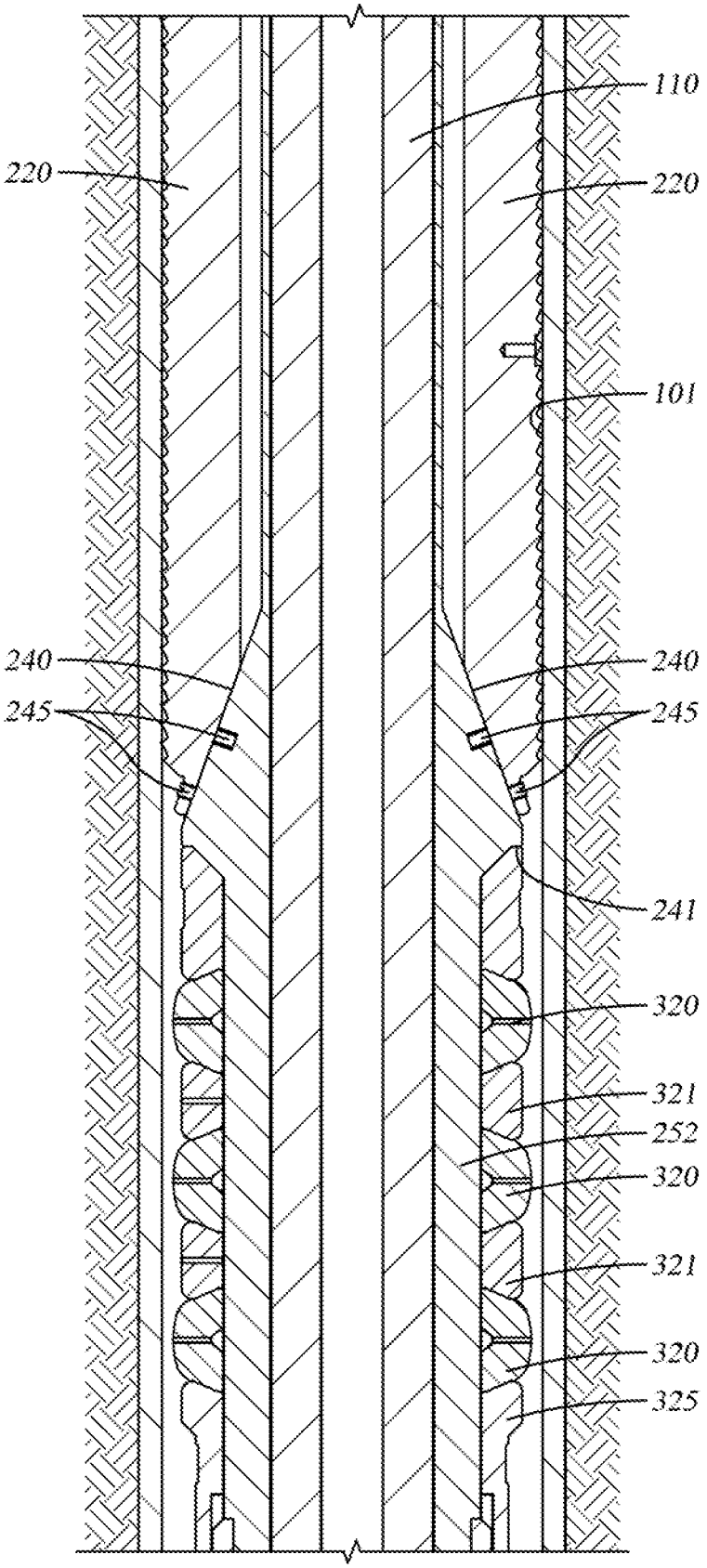
Figure 6C:
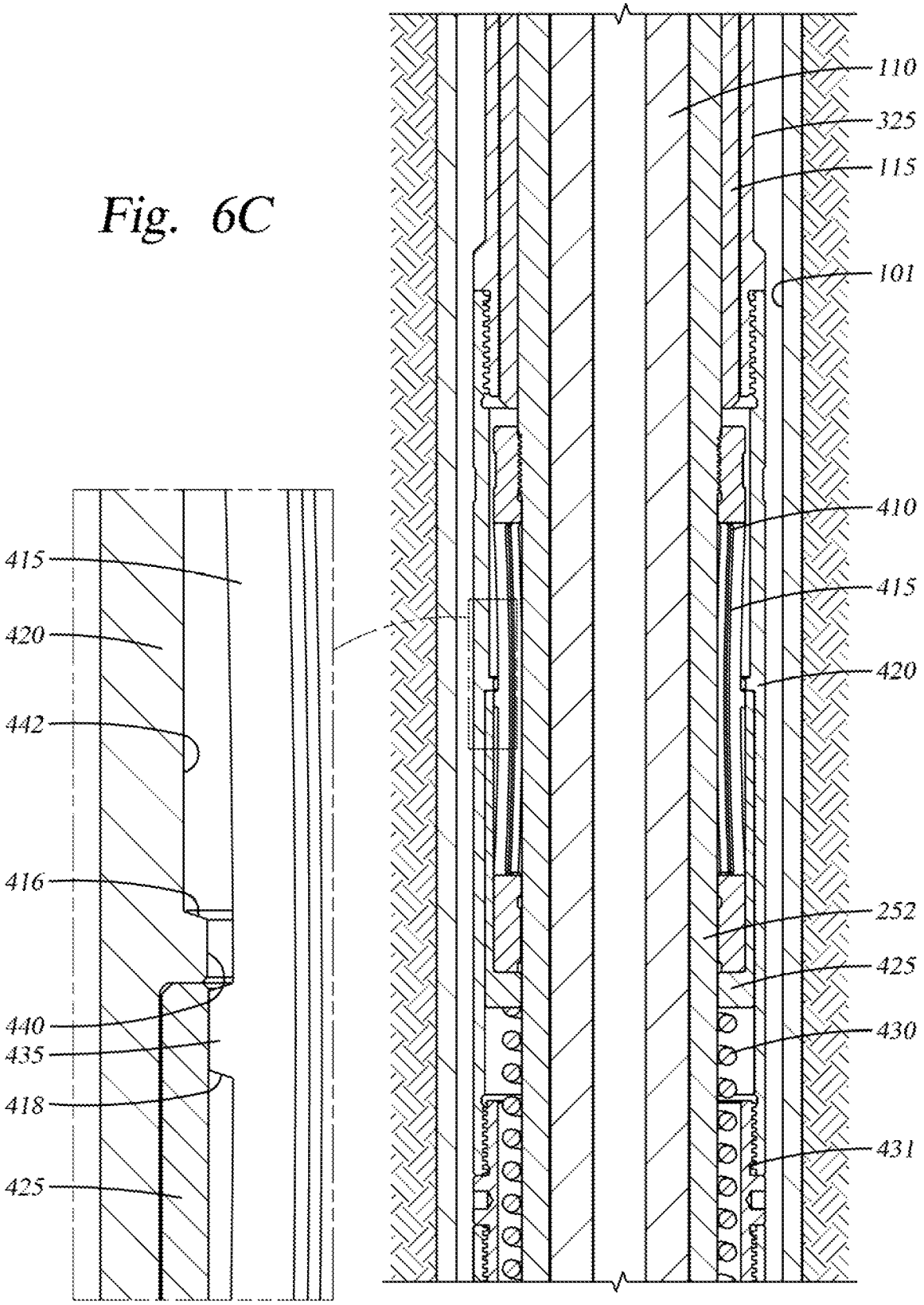
Figure 6D:
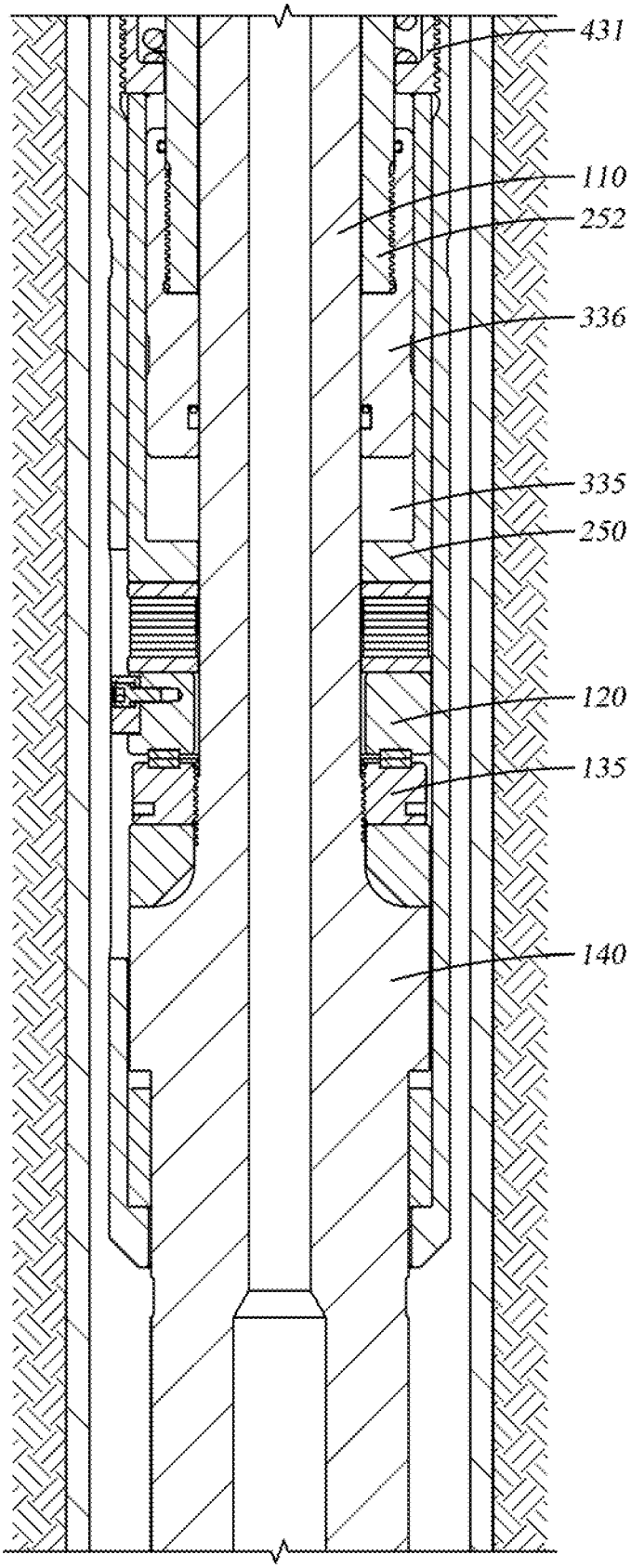
Figure 7A:
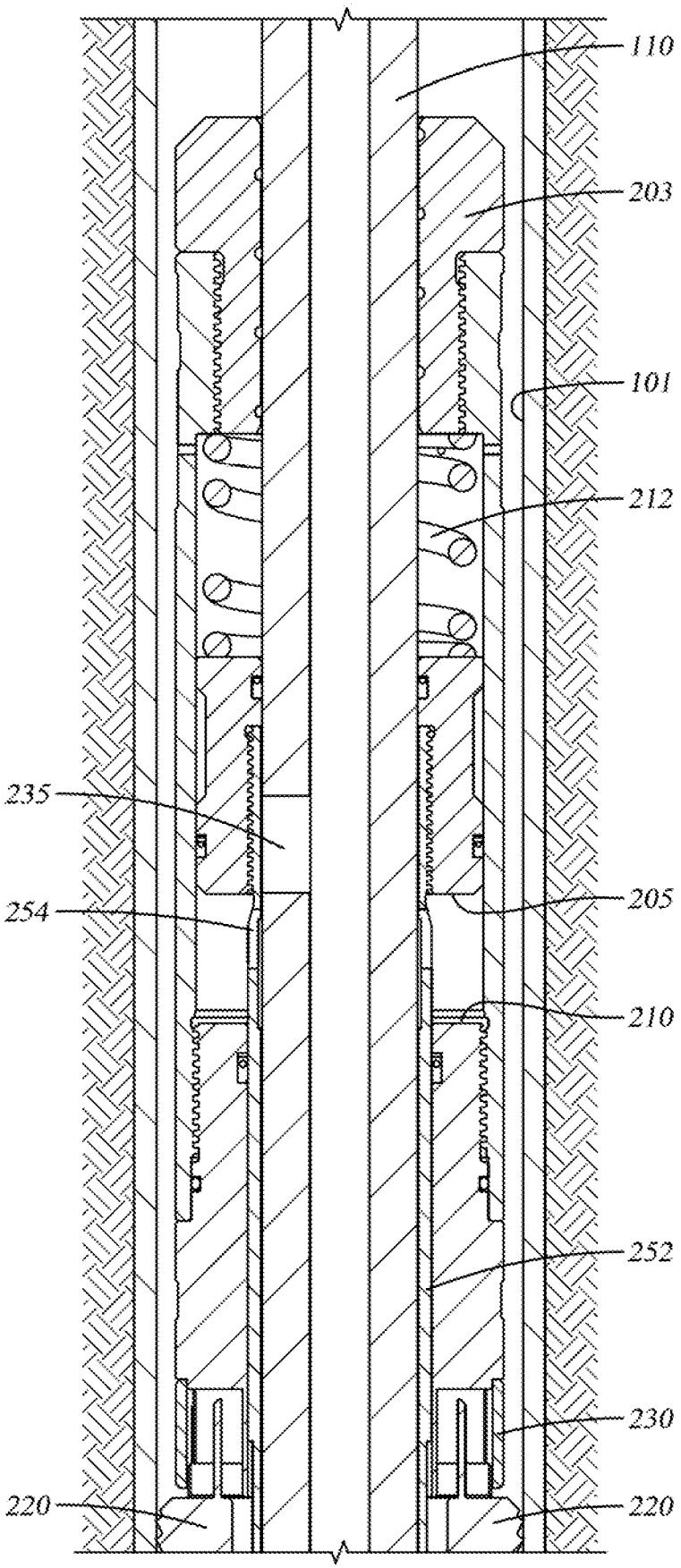
FIGS. 7A-D are section views of the tool showing the packer set in the wellbore.
Figure 7B:
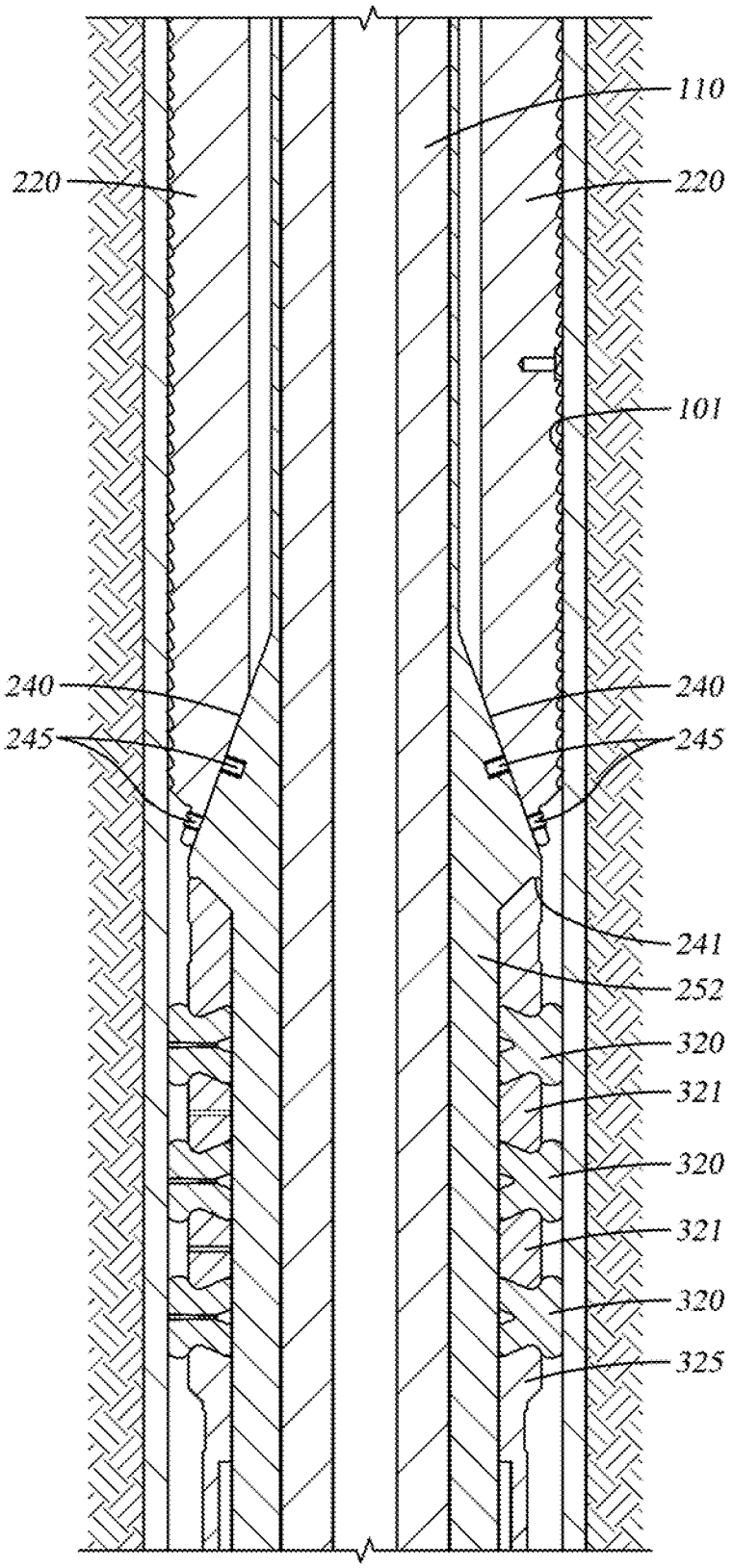
Figure 7C:
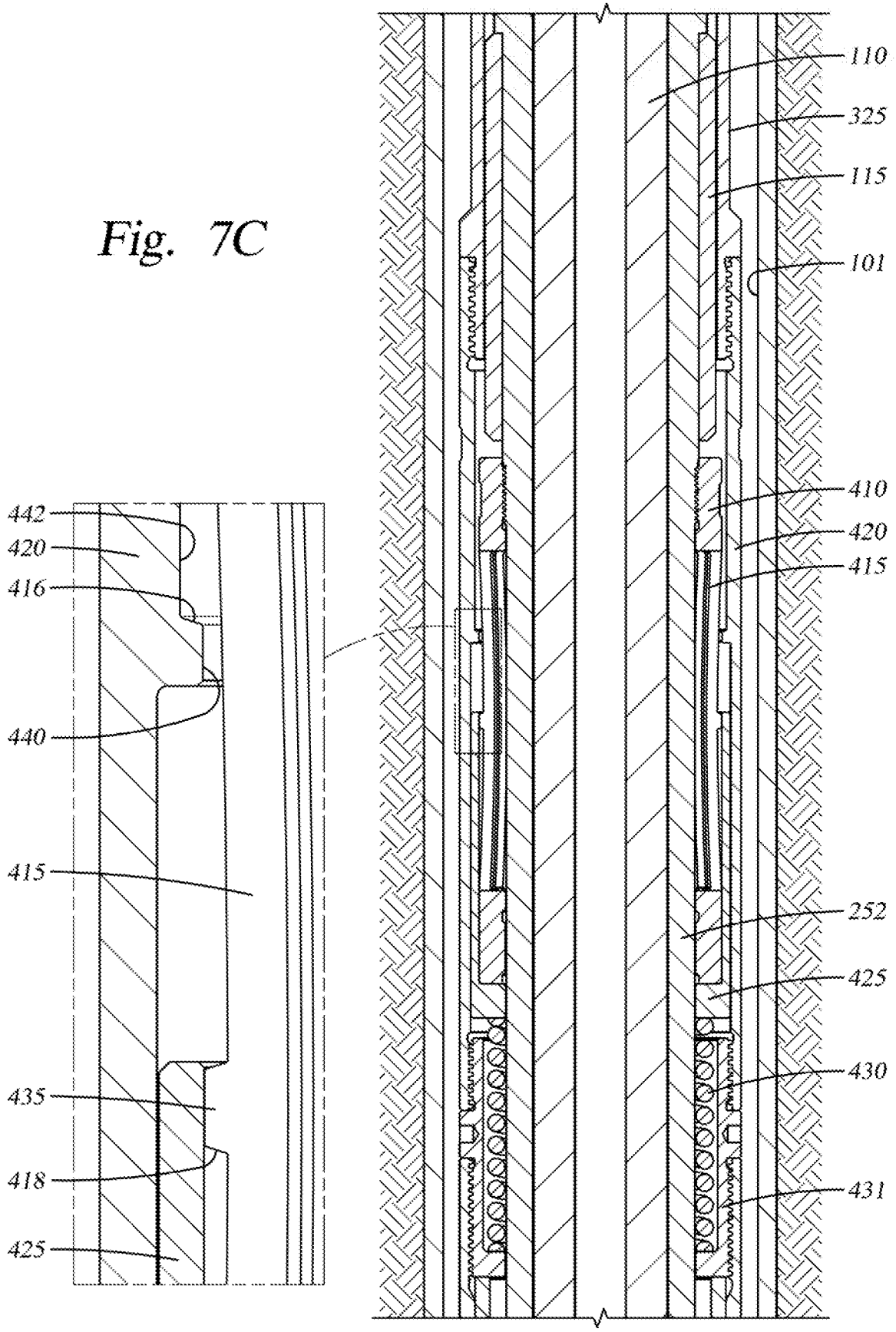

The locking system 400 of the packer 300 prevents its inadvertent actuation. The locking system includes the collet sleeve 410 with its radially disposed fingers 415, all of which must be deflected inwardly in order to unlock the packer and allow it to be set. In FIG. 4C two of the fingers are visible. An enlarged view of the locking system in the area of the fingers 415 is provided on the left side of the Figure. Each finger has an outwardly facing tab 435 that, in the locked positon rests above an inwardly facing upset 440 that extends around an adjacent inner surface 442 of the collet housing 420. The upset 440 can also be appreciated in FIG. 3C. To unlock the packer, it is necessary to move the collet housing upwards in relation to the collet sleeve 410. The position of the upset 440 under the tabs 435 prevents that from happening until enough upwards force is applied to the collet housing to allow an angled surface 416 of the upset 440 to interact with a corresponding angled surface 418 of the fingers and deflect the fingers inwards far enough for the upset to move past the fingers (FIG. 6C). Just below the tabs 435 of the fingers 415 is a spring-loaded sleeve 425 biased upwards by a spring 430 against an underside of the upset. The purpose of the sleeve is to keep the collet fingers in their deflected position as the collet housing 420 moves upwards as the packer elements 320 are compressed from below. In one embodiment, the sleeve 425 is dimensioned whereby the tabs 435 are forced inwards an additional distance as can be appreciated by comparing FIGS. 5C, 6C, and 7C. The purpose of an additional, slight deflection is to facilitate resetting of the locking system whereby two "steps" are created as the tabs move outwards to their original, non-deflected position as shown in 5C.

FIGS. 6A-D are section views showing the tool in the wellbore with the slip assembly 200 set and the locking system 400 of the packer in an unlocked position. As shown clearly in FIG. 6C, the components of the packer assembly 300 and locking system are shown at the instant when the packer is unlocked due to relative movement between the inwardly facing upset 440 of the collet housing 420 and the outwardly facing tabs 435 of the collet fingers 415. As illustrated, the collet fingers have been deflected inwards due to upward force applied to the collet housing 420 which has permitted a sliding action between angles 416, 418 of the upset 440 and tabs 435 of the fingers 415. The tabs of the displaced fingers have come to rest on an upper end of the spring-loaded sleeve 425 in order to keep them deflected and permit the locking system 400 to be re-set if needed.

The force required to deflect the fingers and "unlock" the locking mechanism of the packer assembly 300 is supplied from the surface where, in one embodiment, 70,000 lbs. of upward force is required over and above the upward force already keeping the slip assembly 200 set against the wellbore wall. The upward force on the work string acts primarily on an enlarged diameter portion 140 of the mandrel 110 visible in FIG. 6D. The enlarged diameter portion serves to urge the movable parts of the lower portion of the assembly, including the collet housing 420 upwards as if they are being pushed, in order to set the packer once the locking system has been unlocked. The distance needed to compress the elements 320 and set the packer is a distance equal to the gap 335 shown between L-shaped member 250 and stop sleeve 336 in FIG. 6D.

Figure 7D:
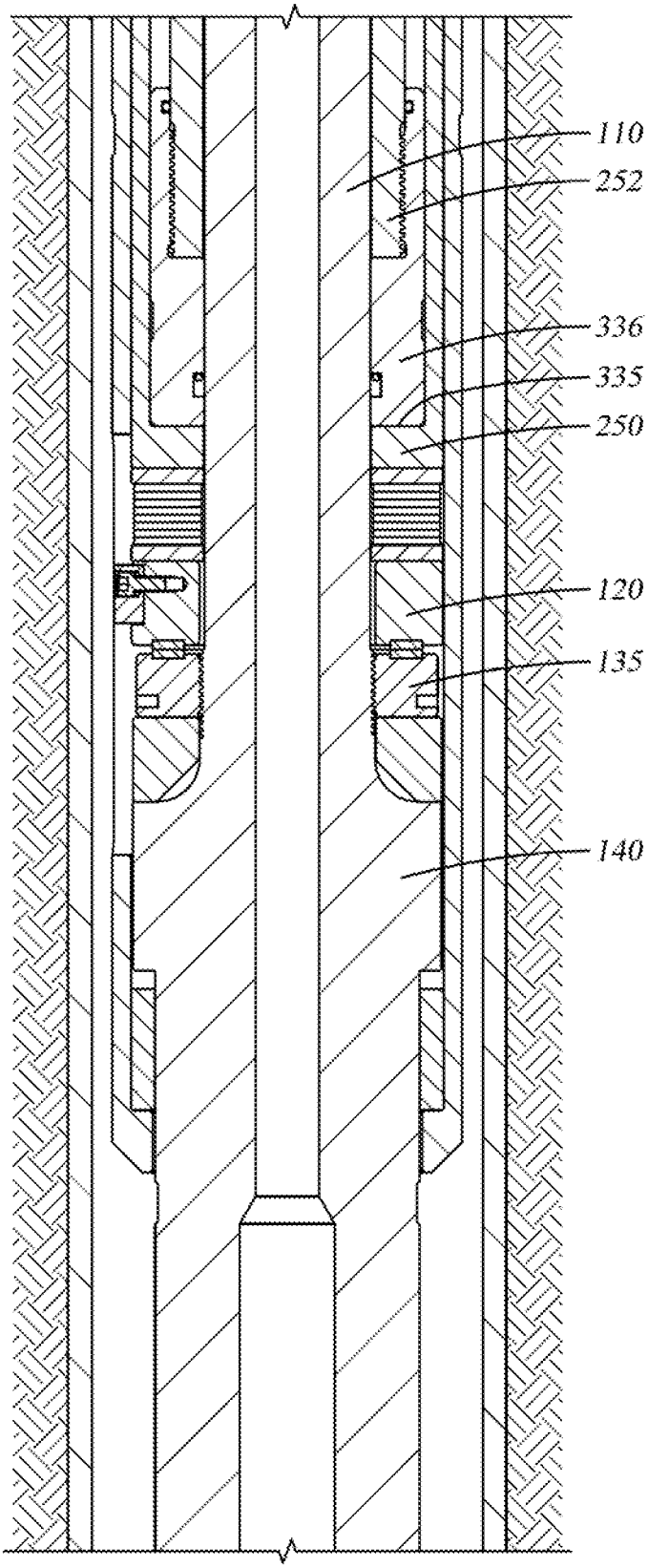

FIGS. 7A-D are section views of the tool showing the packer assembly 200 set in the wellbore 101. As with FIGS. 5A-D and 6A-D, the slip assembly 200 remains set due to upward fore on the mandrel 110 via a work string from the surface of the well. Comparing the Figures to 6A-D, the upward force applied to unlock the packer assembly has moved the mandrel and its enlarged diameter portion upwards along with the collet housing 420. The result is a movement between the parts equal to the gap 335 shown in FIG. 6D. The portions of the locking system are in essentially the same position as they were in FIGS. 6A-D. However, that part of the assembly associated with the collet housing 420 has moved upwards in relation to the collet sleeve 410 in order to compress the packer elements 320. In FIG. 7D, the gap 335 of FIG. 6D has now been closed, reflecting the distance that the elements 320 have been compressed. As described herein, the locking system 400 of the packer assembly 300 requires a high upward force on the work string to move the upset 440 of the collet housing 420 against the tabs 435 of the fingers 415 in order to displace the fingers inward and permit upward movement of the housing. Once unlocked, the movement required to actually set the packer and compress the element requires little force and, due the upward force remaining on the string, takes place instantaneously. As shown in FIGS. 7A-D, the packer element has been compressed between the underside 241 of the conical shape 240 and the upward facing shoulder formed at the lower end of the element.

In operation, the assembly of the present invention can be utilized in a number of different ways. In one example, the tool is used with a cutting tool for separating an upper portion of a casing in the wellbore from a lower portion. Cutting tools for severing tubulars in a wellbore are well known. One example is described in US patent publication number 2018/0258734 assigned to the same assignee as the present invention and that publication is incorporated herein in its entirety. Preferably, the cutting tool has radially extendable cutters that extend outwardly at a predetermined time into contact with the walls of the surrounding tubular. Thereafter, the tubing is severed by rotational movement of the cutting tool. As described herein, a center portion of the tool 100, including the mandrel 110 is constructed and arranged to be rotatable relying in part on bearing member 135 and various keyed relationships between portions of the tool, like the ring with lugs 120 and slots 130 of sleeve 125.

In one embodiment, the tool 100 is run into a wellbore 101 on a work string with a cutting tool (not shown) disposed on the string therebelow. The purpose of the operation is to sever a tubular lining the wellbore. The combination of tools is run into a location adjacent the location where the surrounding tubular is to be severed. Thereafter, fluid is pumped through the work string and through port 235 formed in a wall of the mandrel 110. As the fluid acts upon two opposing piston surfaces 205, 210, set screws 245 pinning the slips 220 in a run-in position relative to the conical shape 240 are broken and the slips are moved downwards along the conical member and into contact with the walls of the surrounding tubular. Thereafter, an upward force is applied to the work string to keep the slips set in a wedging relationship between the conical shape and the wellbore wall 101. With the tool combination fixed in a predetermined location in the wellbore, the cutting tool is operated by rotating the work string from the surface while upward force is maintained to keep the slips set. Once the cutting tool has successfully severed the tubular, the entire assembly including the upper portion of the tubular is lifted using the slips that remain engaged. Due to the weight of the severed tubular being lifted, the packer in most cases will be unlocked and moved to a set position. However, in this operation having the packer set has no bearing on the result of retrieving the tubular portion to the surface of the well.

In another scenario, the operation is carried out as above but, due to interference by wellbore debris between the tubular lining the wellbore and the borehole therearound, the severed tubular cannot be successfully lifted. In this instance, additional lifting force is applied to the work string from the surface of the well. At about 75,000 lbs. of force, the locking system 400 of the packer assembly 300 is unlocked according to the operations described in relation to the forgoing Figures, especially FIGS. 5C and 6C. Thereafter, fluid is pumped out a lower end of the string, below the cutting tool where it "washes" the area between an outer surface of the tubular and the borehole therearound using the area where the tubular was cut as a fluid path to the outer surface. In this manner, debris such as dirt that can hamper the lifting and separation of the upper portion of the tubular from the lower portion can be disturbed. In some instances, another packer is set below the cutting tool so that the washing fluid is trapped between the lower packer and the packer of the tool 100, forcing it out of the tubular and into the area of the borehole. In other instances, a cement plug previously placed in the wellbore creates a barrier below the tool. In addition to its "washing" function, the fluid pumped between the packers/cement plug can be pressurized and provide additional lifting force. If the operation is successful, the tool, cutting tool and upper section of tubular are lifted to the surface with the slip and packer assembly remaining set.

In yet another scenario, the initial lifting is unsuccessful and the washing procedure described above is also unsuccessful in loosening the upper portion of tubular to a point where it can be dislodged and raised. In this case, the entire assembly including the tool 100 and cutting tool can be repositioned at another, typically higher location where the process will be attempted again. In order to reposition the assembly, the slips and packer must first be unset. By reducing lifting force on the string, the locking system 400 of the packer assembly 300 is first re-set as the collet housing 420 with its inwardly facing upset 440 is moved down relative to the collet sleeve 410 with its displaced fingers 415 with their outwardly extending tabs 435. Due to the same angles 416, 418 of the upset 440 and tabs 435, the re-setting of the locking system requires relatively little force compared to the 70,000 lbs. necessary to move them to the unlocked position. Once the packer is returned to its unset position with its locking system re-set, additional downward movement releases the slips and the spring-loaded cap urges the slips to their run-in position. Thereafter, the assembly including the tool 100 and cutting tool, or any other tool attached thereto, can be raised to a higher location in the wellbore where the slip assembly 200 will be reset and if needed, the locking system 400 of the packer 300 can be unlocked and the packer set just as it was in the prior attempt.

While the foregoing is directed to embodiments of the present disclosure, other and further embodiments of the disclosure may be devised without departing from the basic scope thereof, and the scope thereof is determined by the claims that follow.

The invention claimed is:

1. A downhole tool comprising:

a set of slips for maintaining the tool in an axial location in a wellbore, the slips flow actuated and then maintained in a set position due to a first force applied to the tool in the wellbore; and a packer for sealing an annular area around the tool, the packer including a locking system, wherein the locking system includes a collet sleeve with inwardly displaceable fingers and a collet housing surrounding the sleeve, and wherein the locking system is unlocked by an additional force applied to the tool in the wellbore while the slips remain set.

2. The tool of claim 1, wherein, the sleeve and housing of the locking system have opposing angles constructed and arranged to prevent the sleeve and housing from axial movement relative to one another until the fingers are displaced due to a force placed on the sleeve.

3. The tool of claim 2, wherein one of the opposing angles is formed on a formation in the interior of the housing and the other of the opposing angles is formed on an outwardly extending tab formed on each finger.

4. The tool of claim 3, wherein the additional force to unlock the packer is about 70,000 lbs.

5. The tool of claim 4, further including a cutting tool disposed below the tool on the same work string, the cutting tool for severing a tubular lining a wellbore.

6. The tool of claim 5, wherein the cutting tool is operated by rotation of the work string.

7. The tool of claim 6, wherein the tool is constructed and arranged whereby when the cutting tool is rotated, the slips and packer are prevented from rotation.

8. The tool of claim 7, wherein the locking system is re-actuated by a release of the additional force.

9. The tool of claim 8, wherein the slips are unset by release of the first force.

10. The tool of claim 1, wherein the first force and the additional force are applied from the surface of the wellbore.

11. The tool of claim 10, wherein the first force and the additional force are upward forces.

12. A downhole apparatus comprising:

a set of slips for maintaining the tool in an axial location in a wellbore, the slips flow actuated and maintained in a set position due to a first upward force applied to the tool in the wellbore; and a tool for performing a downhole task, the apparatus including a locking system to prevent premature actuation of the tool, wherein the locking system comprises a first portion including a collet sleeve having a plurality of displaceable members, a second portion disposed around the first portion, the second portion including a collet housing, and wherein the locking system is unlocked by an additional upward force applied to the tool in the wellbore while the slips remain set.

13. The downhole apparatus of claim 12, wherein the locking system comprises:

a locked position wherein axial movement between the members is prevented; and an unlocked position wherein axial movement between the members is permitted and wherein the displaceable members of the collet sleeve are displaced in the unlocked position, the displaceable members each including a tab formed on an outer surface thereof, each tab including a lower tab angle and the collet housing including an upset formed on an inner surface thereof, the upset including an upper angled surface constructed and arranged to matingly contact the lower tab angles of the displaceable members in the locked position.

14. The downhole apparatus of claim 13, wherein moving the locking system from the locked to the unlocked position requires enough upward movement of the second portion relative to the first position for the upper angled surface of the upset to move past the lower tab angles, thereby deflecting the displaceable members inwards a first distance and permitting axial movement between the sleeve and the housing.

15. The downhole apparatus of claim 14, wherein after the locking system is unlocked, the displaceable members are displaced a second additional distance.

16. The downhole apparatus of claim 15, wherein movement from the locked to the unlocked position requires a first higher force and movement from the unlocked to the locked position requires a second lesser force.

* * * * *